US011300115B2

(12) United States Patent
Tanaka

(10) Patent No.: US 11,300,115 B2
(45) Date of Patent: Apr. 12, 2022

(54) PUMP AND FLUID CONTROL DEVICE

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 107 days.

(21) Appl. No.: 16/835,541

(22) Filed: Mar. 31, 2020

(65) Prior Publication Data

US 2020/0224650 A1 Jul. 16, 2020

Related U.S. Application Data

(63) Continuation of application No. PCT/JP2018/041612, filed on Nov. 9, 2018.

(30) Foreign Application Priority Data

Dec. 26, 2017 (JP) ..... JP2017-249122

(51) Int. Cl.
*F04B 45/04* (2006.01)
*F04B 45/047* (2006.01)

(52) U.S. Cl.
CPC ..... *F04B 45/045* (2013.01); *F04B 45/047* (2013.01)

(58) Field of Classification Search
CPC ..... F04B 45/10; F04B 45/045; F04B 45/047
See application file for complete search history.

(56) References Cited

U.S. PATENT DOCUMENTS 2,144,662 A * 1/1939 Paasche ..... F04B 45/045 417/479
10,794,378 B2 * 10/2020 Tanaka ..... F04B 45/045
2009/0087323 A1 4/2009 Blakey et al.
2013/0223979 A1 8/2013 Locke et al.
(Continued)

FOREIGN PATENT DOCUMENTS

JP 2008-537057 A 9/2008
JP 2012-528980 A 11/2012
JP 2015-511703 A 4/2015
(Continued)

OTHER PUBLICATIONS

International Search Report issued in Application No. PCT/JP2018/041612, dated Jan. 29, 2019.
(Continued)

*Primary Examiner* — Charles G Freay
(74) *Attorney, Agent, or Firm* — Pearne & Gordon LLP

(57) ABSTRACT

A pump includes a first diaphragm, a second diaphragm, and a circumferential wall, which define a pump chamber, and a driver. The driver vibrates the first diaphragm and the second diaphragm in a flexural mode to cause pressure fluctuation in the pump chamber. The first diaphragm has a first hole to which no check valve is attached. At least one of the first diaphragm and the second diaphragm has a second hole to which a check valve is attached. The first hole is located at a portion that coincides with an axis orthogonal to a center of the first diaphragm and a center of the second diaphragm. The second hole is located at a portion that does not coincide with the first hole when viewed in a direction in which the axis extends.

16 Claims, 8 Drawing Sheets

(56) References Cited

U.S. PATENT DOCUMENTS

| | | | |
|---|---|---|---|
| 2016/0348666 | A1 | 12/2016 | Tanaka |
| 2018/0187672 | A1 | 7/2018 | Tanaka et al. |

FOREIGN PATENT DOCUMENTS

| | | | |
|---|---|---|---|
| JP | 2016-113953 | A | 6/2016 |
| WO | 2010-139916 | A1 | 12/2010 |
| WO | 2015-125608 | A1 | 8/2015 |
| WO | 2017-038565 | A1 | 3/2017 |

OTHER PUBLICATIONS

Written Opinion issued in Application No. PCT/JP2018/041612, dated Jan. 29, 2019.

* cited by examiner

1A

PUMP AND FLUID CONTROL DEVICE

This is a continuation of International Application No. PCT/JP2018/041612 filed on Nov. 9, 2018 which claims priority from Japanese Patent Application No. 2017-249122 filed on Dec. 26, 2017. The contents of these applications are incorporated herein by reference in their entireties.

BACKGROUND

Technical Field

The present disclosure relates to a positive-displacement pump that operates using flexural vibration of a diaphragm, and to a fluid control device that includes the positive-displacement pump, and particularly, to a piezoelectric pump that includes a piezoelectric device for use as a driver that drives a diaphragm, and to a fluid control device that includes the piezoelectric pump.

A piezoelectric pump, which is an example of a positive-displacement pump, is known. The piezoelectric pump includes a diaphragm to which a piezoelectric device is bonded. The diaphragm defines at least part of a pump chamber. The piezoelectric pump drives the diaphragm at a resonant frequency by applying an AC voltage of a predetermined frequency to the piezoelectric device to cause pressure fluctuation in the pump chamber to enable suction and discharge of a fluid.

Examples of documents that disclose structure examples of a piezoelectric pump include Japanese Unexamined Patent Application Publication (Translation of PCT Application) No. 2012-528980 (Patent Document 1) and International Publication No. 2015/125608 (Patent Document 2). The piezoelectric pumps disclosed in Patent Documents 1 and 2 have a structure where a pair of diaphragms disposed opposite to each other define a pump chamber, and a piezoelectric device is bonded to one of the paired diaphragms.

In the piezoelectric pumps disclosed in Patent Documents 1 and 2, a diaphragm of the paired diaphragms to which no piezoelectric device is bonded has one hole, to which a check valve is attached, at the center portion of the diaphragm. The diaphragm of the paired diaphragms to which the piezoelectric device is bonded has multiple holes, which are annularly arranged in sequence and to which no check valve is attached, at an intermediate portion excluding the center portion and the surrounding portion of the diaphragm.

In the piezoelectric pump having the above structure, the piezoelectric device causes the pair of diaphragms to vibrate in a flexural mode so that they are displaced in opposite directions. Thus, pressure fluctuation occurs in the pump chamber. In accordance with the pressure fluctuation in the pump chamber, a fluid located outside the pump chamber is sucked through either the single hole in the diaphragm to which the piezoelectric device is not bonded or the multiple holes in the diaphragm to which the piezoelectric device is bonded. The fluid is thereafter discharged through the other hole/holes. The piezoelectric pump thus exerts its pumping function.

The check valve attached to the single hole in the diaphragm to which no piezoelectric device is bonded is passively opened or closed in accordance with pressure fluctuation of the pump chamber. Whether the check valve is disposed on the main surface of the diaphragm facing the pump chamber or on the main surface of the diaphragm facing away from the pump chamber determines the direction of flow of the fluid produced in the piezoelectric pump.

Patent Document 1: Japanese Unexamined Patent Application Publication (Translation of PCT Application) No. 2012-528980

Patent Document 2: International Publication No. 2015/125608

BRIEF SUMMARY

Generally, to increase the flow rate of a fluid feedable with pressure by the piezoelectric pump, enlarging the diameter of the pump chamber or rising the vibration frequency of the diaphragm is effective. However, the product of the radius of the pump chamber and the vibration frequency of the diaphragm has to satisfy an appropriate value to obtain a sufficient pumping function. The appropriate value is determined depending on, for example, the shape of the flexural vibration caused in the diaphragm and the positions of the holes formed in the diaphragms. Thus, enlarging the diameter of the pump chamber is not easy, and increasing the flow rate of the piezoelectric pump having the same structure is significantly difficult.

Thus, the present disclosure was made in view of the above problem, and aims to provide a positive-displacement pump that operates using flexural vibration of a diaphragm and a fluid control device that includes the positive-displacement pump, the pump increasing the flow rate compared to an existing pump.

A pump according to the present disclosure includes a first diaphragm, a second diaphragm, a circumferential wall, a pump chamber, and a driver. The second diaphragm faces the first diaphragm. The circumferential wall connects a periphery of the first diaphragm and a periphery of the second diaphragm. The pump chamber is located between the first diaphragm and the second diaphragm, and defined by the first diaphragm, the second diaphragm, and the circumferential wall. The driver causes the first diaphragm and the second diaphragm to vibrate in a flexural mode to cause pressure fluctuation in the pump chamber. The first diaphragm has a first hole to which no check valve is attached. The first hole is located to coincide with an axis orthogonal to a center of the first diaphragm and a center of the second diaphragm, when viewed in the direction in which the axis extends. At least one of the first diaphragm and the second diaphragm has a second hole to which a check valve is attached. The second hole is located not to coincide with the first hole when viewed in the direction in which the axis extends.

In the pump according to the present disclosure, the second hole may be formed in the second diaphragm.

In the pump according to the present disclosure, the second hole may be provided in a plurality. In this case, the plurality of second holes can be arranged in sequence on a circumference having the axis at the center when viewed in the direction in which the axis extends.

In the pump according to the present disclosure, an opening area of the first hole can be greater than a sum of opening areas of the plurality of second holes.

In the pump according to the present disclosure, no holes other than the first hole and the second hole/holes can be formed in any of the first diaphragm, the second diaphragm, and the circumferential wall.

In the pump according to the present disclosure, at least one of the first diaphragm and the second diaphragm may have a third hole to which no check valve is attached. In this case, the third hole can be formed in an area having the axis at the center on an outer side of an area where the second hole is formed when viewed in the direction in which the axis extends.

In the pump according to the present disclosure, the second hole may be formed in the second diaphragm, and the third hole may be formed in the first diaphragm.

In the pump according to the present disclosure, the third hole may be provided in a plurality. In this case, the plurality of third holes can be arranged in sequence on a circumference having the axis at the center when viewed in the direction in which the axis extends.

In the pump according to the present disclosure, the plurality of third holes may be a plurality of cylindrical holes arranged equidistant from each other and having an identical opening diameter. In this case, a distance between each adjacent two third holes of the plurality of third holes can be smaller than the opening diameter of each of the plurality of third holes.

In the pump according to the present disclosure, no holes other than the first hole, the second hole, and the third hole are formed in any of the first diaphragm, the second diaphragm, and the circumferential wall.

In the pump according to the present disclosure, the driver can vibrate the first diaphragm and the second diaphragm in a flexural mode to cause standing waves in both the first diaphragm and the second diaphragm with respect to the axis at the center.

In the pump according to the present disclosure, each of the first diaphragm, the second diaphragm, and the driver can have a circular profile when viewed in the direction in which the axis extends.

In the pump according to the present disclosure, the driver may include a plate-shaped first piezoelectric device. In this case, the first piezoelectric device can be bonded to the second diaphragm.

In the pump according to the present disclosure, the driver may include a plate-shaped second piezoelectric device having a through-hole at a center. In this case, the second piezoelectric device can be bonded to the first diaphragm while allowing the through-hole and the first hole to be continuous with each other.

A fluid control device according to the present disclosure includes the pump according to the present disclosure.

According to the present disclosure, a positive-displacement pump that operates using flexural vibration of a diaphragm, and a fluid control device that includes the positive-displacement pump can increase the flow rate further than an existing pump or device.

DETAILED DESCRIPTION

Embodiments of the present disclosure will now be described below in details with reference to the drawings. Embodiments described below by way of example are cases where the present disclosure is applied to a piezoelectric blower that serves as a pump that sucks and discharges gas. Throughout embodiments described below, the same or common portions are denoted with the same reference signs without necessarily being described repeatedly.

Embodiment 1

Figure 1:
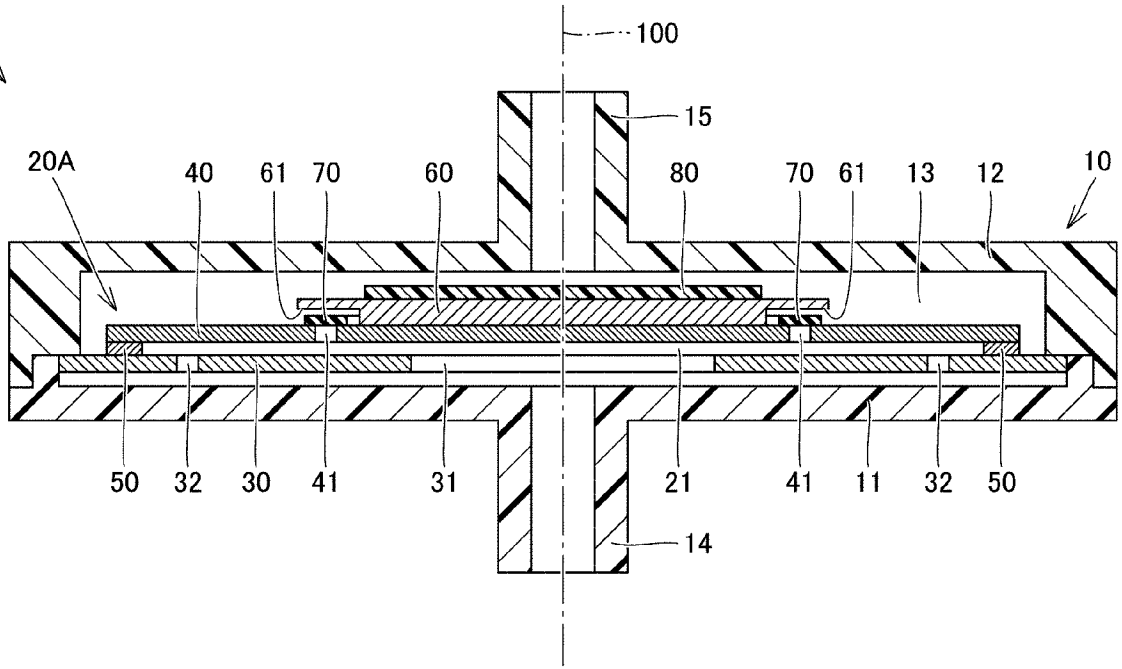
FIG. 1 is a schematic cross-sectional view of a piezoelectric blower according to embodiment 1.
Figure 2:
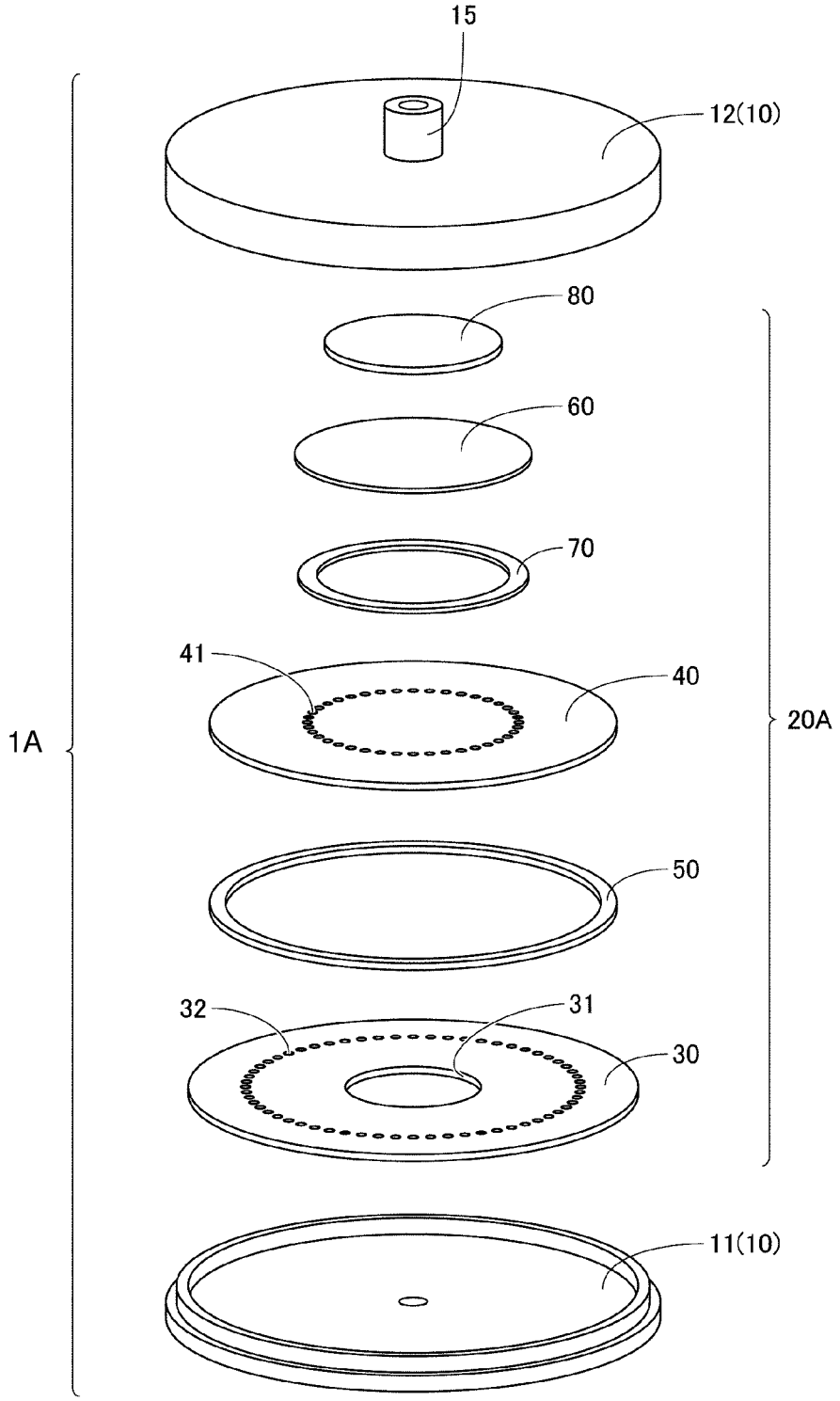
FIG. 2 is an exploded perspective view of the piezoelectric blower illustrated in FIG. 1.

FIG. 1 is a schematic cross-sectional view of a piezoelectric blower according to embodiment 1 of the present disclosure, and FIG. 2 is an exploded perspective view of the piezoelectric blower illustrated in FIG. 1. With reference to FIGS. 1 and 2, a structure of a piezoelectric blower 1A according to the present embodiment will be described.

With reference to FIGS. 1 and 2, the piezoelectric blower 1A according to the present embodiment mainly includes a housing 10 and a driving unit 20A. The housing 10 has an accommodating space 13 inside, which is a flat cylindrical space. The driving unit 20A is disposed in the accommodating space 13.

The housing 10 includes a resin-made or metal-made disk-shaped first case body 11 and a resin-made or metal-made flat bottomed-cylindrical second case body 12. The housing 10 has the above-described accommodating space 13 inside. The accommodating space 13 is formed by assembling the first case body 11 and the second case body 12 together, for example, joining the first case body 11 and the second case body 12 together by an adhesive.

A first nozzle 14 and a second nozzle 15 are respectively disposed to protrude outward at the center portion of the first case body 11 and the center portion of the second case body 12. The external space of the piezoelectric blower 1A and the above-described accommodating space 13 are continuous with each other through the first nozzle 14 and the second nozzle 15.

The driving unit 20A mainly includes a first diaphragm 30, a second diaphragm 40, a spacer 50 serving as a circumferential wall, a valve holding member 60, a check valve 70, and a piezoelectric device 80 corresponding to a first piezoelectric device serving as a driver. The driving unit 20A is formed from these components stacked one on another to be integrated together. The driving unit 20A is held by the housing 10 while being disposed in the accommodating space 13 of the above housing 10. Here, the accommodating space 13 of the housing 10 is divided by the driving unit 20A into a space closer to the first nozzle 14 and a space closer to the second nozzle 15.

The first diaphragm 30 is formed from, for example, a metal thin plate made of stainless steel, and has a circular profile when viewed in a plan. The outer edge of the periphery of the first diaphragm 30 is joined to the housing 10 with, for example, an adhesive. The first diaphragm 30 has one first hole 31 at the center portion. The first diaphragm 30 has multiple third holes 32 in an intermediate portion excluding the center portion and the peripheral portion of the first diaphragm 30. The multiple third holes 32 are annularly arranged in sequence.

The second diaphragm 40 faces the first diaphragm 30. More specifically, the second diaphragm 40 is disposed facing the surface of the first diaphragm 30 opposite to the surface on which the first case body 11 is disposed. The second diaphragm 40 is formed from, for example, a metal thin plate made of, such as stainless steel, and has a circular profile when viewed in a plan. The second diaphragm 40 has multiple second holes 41 in an intermediate portion excluding the center portion and the peripheral portion of the second diaphragm 40. The multiple second holes 41 are annularly arranged in sequence.

The spacer 50 is disposed between the first diaphragm 30 and the second diaphragm 40 to be held between the first diaphragm 30 and the second diaphragm 40. The spacer 50 is formed from, for example, a metal member made of, such as stainless steel, and has an annular profile.

The spacer 50 connects a portion of the periphery of the first diaphragm 30 excluding the above-described outer edge, to the periphery of the second diaphragm 40. Thus, the first diaphragm 30 and the second diaphragm 40 are disposed with a predetermined distance apart from each other by the spacer 50. The spacer 50 and the first diaphragm 30 are coupled to each other with, for example, an adhesive. The spacer 50 and the second diaphragm 40 are coupled to each other with, for example, an adhesive.

The space located between the first diaphragm 30 and the second diaphragm 40 functions as a pump chamber 21. The pump chamber 21 is defined by the first diaphragm 30, the second diaphragm 40, and the spacer 50, and formed of a flat cylindrical space. Here, the spacer 50 defines the pump chamber 21 and concurrently corresponds to a circumferential wall that connects the first diaphragm 30 and the second diaphragm 40 to each other.

The valve holding member 60 is bonded at a center portion of the second diaphragm 40 with, for example, an adhesive. More specifically, the valve holding member 60 is disposed on the surface of the second diaphragm 40 opposite to the surface on which the first diaphragm 30 is disposed. The valve holding member 60 is formed from, for example, a metal thin plate made of, such as stainless steel, and has a circular profile when viewed in a plan. The valve holding member 60 has an annular step portion 61 at the periphery of the main surface located closer to the second diaphragm 40. The annular step portion 61 is recessed in a direction away from the second diaphragm 40. The annular step portion 61 faces the multiple second holes 41 formed in the second diaphragm 40.

The check valve 70 is formed from a resin-made member such as polyimide resin, and has an annular-plate profile. The check valve 70 is loosely fit to the annular step portion 61 of the valve holding member 60 to be accommodated in the annular step portion 61. Specifically, the check valve 70 is located between the annular step portion 61 of the valve holding member 60 and a portion of the second diaphragm 40 facing the annular step portion 61.

Thus, the check valve 70 is movably held by the valve holding member 60 while being allowed to render the multiple second holes 41 formed in the second diaphragm 40 open or closed. More specifically, the check valve 70 closes the multiple second holes 41 when being adjacent to and in close contact with the second diaphragm 40, and renders the multiple second holes 41 open when being spaced apart from the second diaphragm 40.

The piezoelectric device 80 is bonded to the valve holding member 60 with, for example, an adhesive to be bonded at the center portion of the second diaphragm 40 with the valve holding member 60 interposed therebetween. Thus, the piezoelectric device 80 is bonded to the main surface of the second diaphragm 40 opposite to the surface facing the pump chamber 21. The piezoelectric device 80 is formed from a thin plate made of a piezoelectric material such as PZT, and has a circular profile when viewed in a plan.

The piezoelectric device 80 vibrates in a flexural mode in response to an application of an AC voltage. When the flexural vibration caused in the piezoelectric device 80 is transmitted to the first diaphragm 30 and the second diaphragm 40, the first diaphragm 30 and the second diaphragm 40 also vibrate in a flexural mode. Specifically, the piezoelectric device 80 corresponds to a driver that causes the first diaphragm 30 and the second diaphragm 40 to vibrate in a flexural mode. In response to an application of an AC voltage of a predetermined frequency, the piezoelectric device 80 causes the first diaphragm 30 and the second diaphragm 40 to vibrate at respective resonant frequencies, and thus causes standing waves in both of the first diaphragm 30 and the second diaphragm 40.

In the piezoelectric blower 1A according to the present embodiment with this structure, the pump chamber 21 is located between the first nozzle 14 and the second nozzle 15. Thus, the pump chamber 21 and the space of the accommodating space 13 of the housing 10 closer to the first nozzle 14 with respect to the position where the pump chamber 21 is disposed are always continuous with each other with the single first hole 31 and the multiple third holes 32 formed in the first diaphragm 30. Concurrently, the pump chamber 21 and the space in the accommodating space 13 of the housing 10 closer to the second nozzle 15 with respect to the position where the pump chamber 21 is disposed are continuous with each other with the multiple second holes 41 in the second diaphragm 40 in the state where the multiple second holes 41 are not closed by the check valve 70.

Here, in the piezoelectric blower 1A according to the present embodiment, the piezoelectric device 80 causes the first diaphragm 30 and the second diaphragm 40 to vibrate in a flexural mode so that both of the first diaphragm 30 and the second diaphragm 40 cause standing waves with respect to an axis 100 at the center. The axis 100 is orthogonal to the center of the first diaphragm 30 and the center of the second diaphragm 40.

Here, the piezoelectric device 80 directly drives the second diaphragm 40 to which the piezoelectric device 80 is bonded, and indirectly drives the first diaphragm 30 to which the piezoelectric device 80 is not bonded, with the spacer 50 serving as a circumferential wall interposed therebetween. At this time, the first diaphragm 30 and the second diaphragm 40, which have shapes (particularly, the thickness of the diaphragms) designed as appropriate, are displaced in opposite directions.

Vibrations of the first diaphragm 30 and the second diaphragm 40 in the opposite directions cause the pump chamber 21 to repeatedly expand and contract. The vibrations cause resonance inside the pump chamber 21, and the resonance causes large pressure fluctuation in the pump chamber 21. As a result, positive pressure and negative pressure occur in the pump chamber 21 alternately with time. This pressure fluctuation enables a pumping function for feeding gas with pressure.

Figure 3:
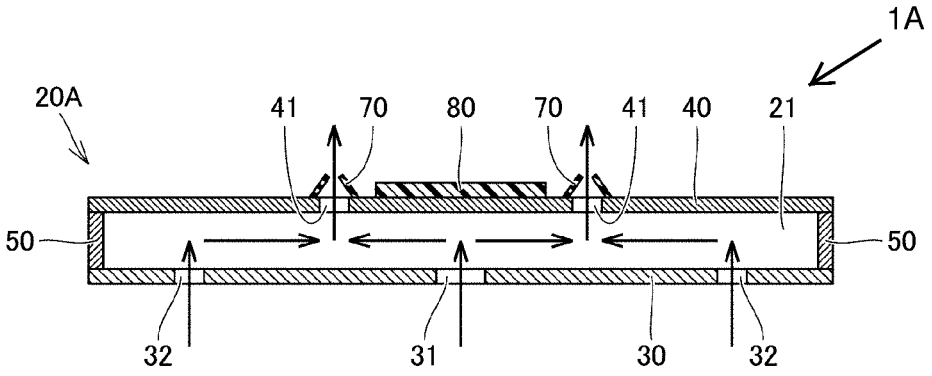
FIG. 3 is a schematic diagram of a structure of a driving unit of the piezoelectric blower illustrated in FIG. 1 and rough directions of air flow caused during an operation of the driving unit.
Figure 4A:
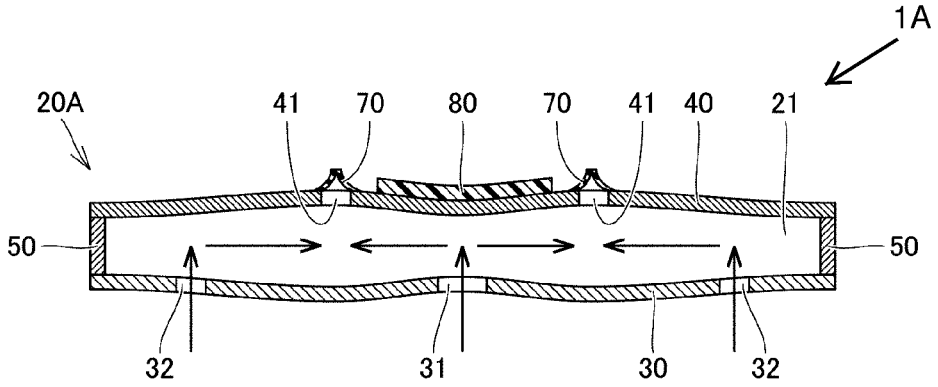
FIGS. 4A and 4B are schematic diagrams illustrating, in time order, the operation state of the driving unit of the piezoelectric blower illustrated in FIG. 1 and the direction of air flow caused at this state.
Figure 4B:
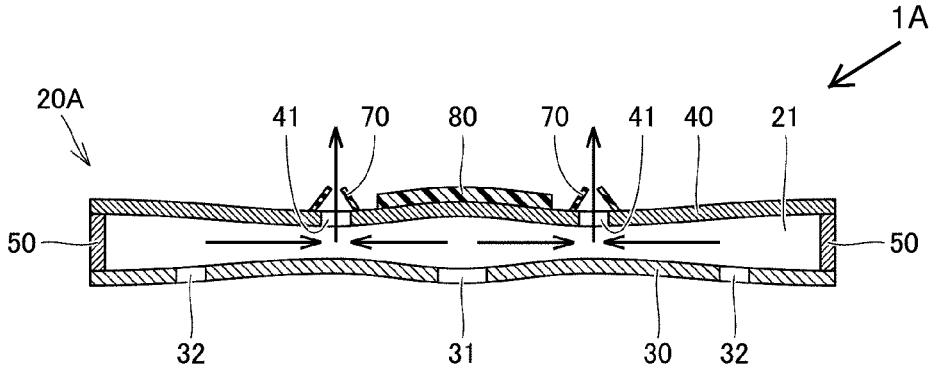

FIG. 3 is a schematic diagram of a structure of a driving unit of the piezoelectric blower illustrated in FIG. 1 and rough directions of air flow caused during an operation of the driving unit. FIGS. 4A and 4B are schematic diagrams illustrating, in time order, the operation state of the driving unit of the piezoelectric blower illustrated in FIG. 1 and the direction of air flow caused at this state. With reference to FIGS. 3, 4A, and 4B, the operation state of the piezoelectric blower 1A according to the present embodiment will be described in detail. In FIGS. 3 and 4, for ease of understanding or for illustration convenience, the structure of the driving unit 20A is simply or schematically illustrated.

With reference to FIG. 3, in the piezoelectric blower 1A according to the present embodiment, as described above, the check valve 70 is attached to the multiple second holes 41 formed in the second diaphragm 40, whereas a check valve is attached to neither the single first hole 31 nor the multiple third holes 32 formed in the first diaphragm 30.

Here, the check valve 70 attached to the multiple second holes 41 is formed to allow gas to flow from the pump chamber 21 toward the space of the accommodating space 13 of the housing 10 closer to the second nozzle 15 and not to allow gas to flow in the opposite direction. Thus, the directions of air flow caused during the operation of the piezoelectric blower 1A are determined by the effect of the check valve 70, and the rough directions of the air flow are the directions indicated with arrows in FIG. 3.

Specifically, as illustrated in FIG. 4A, in the state where the first diaphragm 30 and the second diaphragm 40 are displaced to be spaced apart from each other, the pump chamber 21 expands, so that negative pressure occurs in the pump chamber 21. In accordance with the occurrence of the negative pressure, gas is sucked into the pump chamber 21 through the single first hole 31 and the multiple third holes 32 formed in the first diaphragm 30. At this time, the check valve 70 attached to the multiple second holes 41 formed in the second diaphragm 40 closes the second holes 41 in accordance with the occurrence of negative pressure in the pump chamber 21.

Subsequently, as illustrated in FIG. 4B, in the state where the first diaphragm 30 and the second diaphragm 40 are displaced to come closer to each other, the pump chamber 21 contracts, so that positive pressure occurs in the pump chamber 21. In accordance with the occurrence of the positive pressure, the check valve 70 attached to the multiple second holes 41 formed in the second diaphragm 40 renders the multiple second holes 41 open, so that gas is discharged from the pump chamber 21 through the multiple second holes 41.

The first diaphragm 30 and the second diaphragm 40 vibrate to repeatedly alternate the state illustrated in FIG. 4A and the state illustrated in FIG. 4B, so that the air flow in the direction illustrated in FIG. 3 occurs in the piezoelectric blower 1A. Thus, the first nozzle 14 formed in the housing 10 functions as a suction nozzle that sucks gas from the outside, and the second nozzle 15 formed in the housing 10 functions as a discharge nozzle that discharges gas to the outside. Thus, the piezoelectric blower 1A feeds gas with pressure.

In the above-described piezoelectric blower 1A according to the present embodiment, with reference to FIGS. 1 to 4, the single first hole 31 and the multiple third holes 32 formed in the first diaphragm 30 and the multiple second holes 41 formed in the second diaphragm 40 satisfy the following relationship.

The first diaphragm 30 has the single first hole 31 at a portion that coincides with the axis 100 when viewed in the direction in which the axis 100 extends. No check valve is attached to the single first hole 31.

The second diaphragm 40 has the multiple second holes 41, which do not coincide with the first hole 31 when viewed in the direction in which the axis 100 extends. The check valve 70 is attached to the multiple second holes 41. The multiple second holes 41 are arranged in sequence on the circumference having the axis 100 at the center when viewed in the direction in which the axis 100 extends.

In addition to the single first hole 31, the first diaphragm 30 has the multiple third holes 32 in an area having the axis 100 at the center on the outer side of the area where the multiple second holes 41 are formed when viewed in the direction in which the axis 100 extends. No check valve is attached to the multiple third holes 32. The multiple third holes 32 are arranged in sequence on the circumference having the axis 100 at the center when viewed in the direction in which the axis 100 extends.

No holes other than the single first hole 31, the multiple second holes 41, and the multiple third holes 32 are formed in any of the first diaphragm 30, the second diaphragm 40, and the spacer 50, which define the pump chamber 21.

The piezoelectric blower 1A according to the present embodiment with this structure can increase the flow rate compared to an existing structure. The reason why the piezoelectric blower 1A according to the present embodiment can increase the flow rate will be described below in detail in comparison with a piezoelectric blower 1X according to a comparative embodiment.

Figure 5:
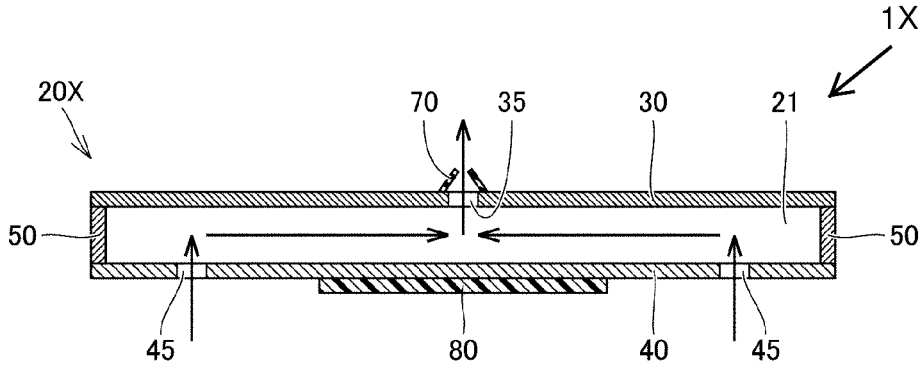
FIG. 5 is a schematic diagram of a structure of a driving unit of a piezoelectric blower according to a comparative embodiment and rough directions of air flow caused during an operation of the driving unit.
Figure 6:
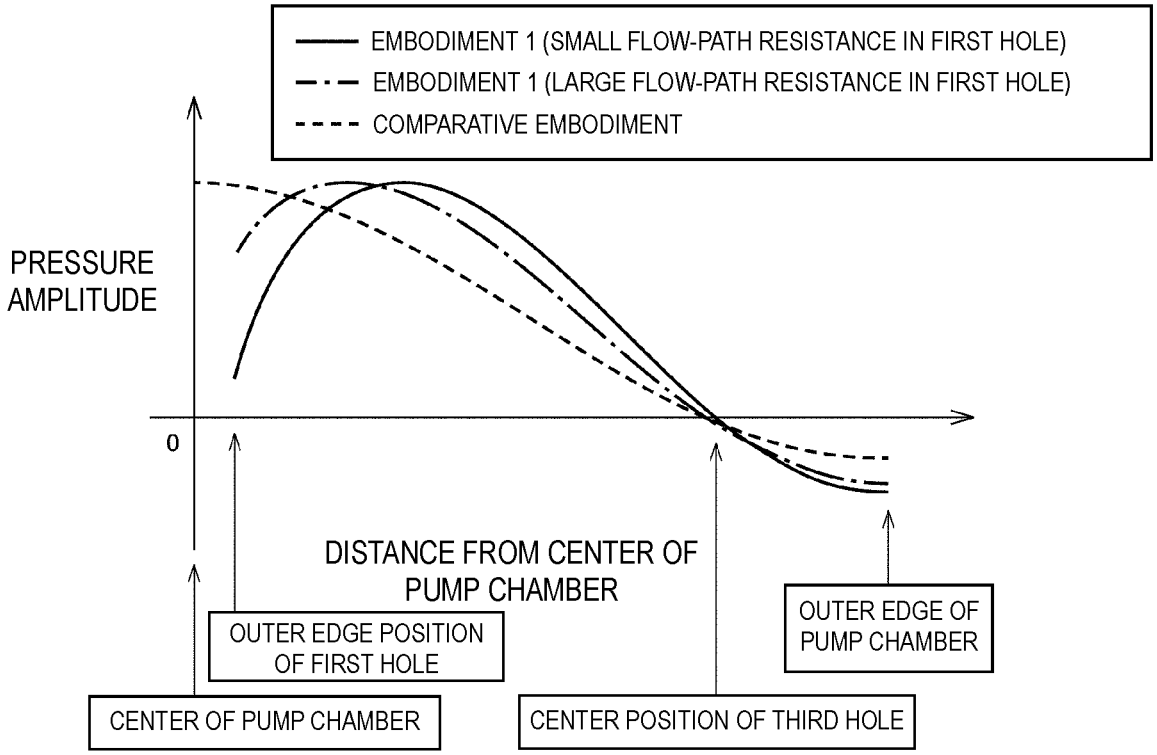
FIG. 6 is a graph for comparing pressure fluctuation caused in a pump chamber of a piezoelectric blower according to embodiment 1 and pressure fluctuation caused in a pump chamber of a piezoelectric blower according to a comparative embodiment.

FIG. 5 is a schematic diagram of a structure of a driving unit of a piezoelectric blower according to a comparative embodiment and rough directions of air flow caused during an operation of the driving unit. FIG. 6 is a graph for comparing pressure fluctuation caused in a pump chamber of a piezoelectric blower according to the present embodiment and pressure fluctuation caused in a pump chamber of a piezoelectric blower according to a comparative embodiment, which will be described below.

As illustrated in FIG. 5, the piezoelectric blower 1X according to the comparative embodiment includes a driving unit 20X, which has a structure different from the driving unit in the piezoelectric blower 1A according to the present embodiment. As in the case of the driving unit 20A of the piezoelectric blower 1A according to the present embodiment, the driving unit 20X includes a first diaphragm 30, a second diaphragm 40, a spacer 50, and a piezoelectric device 80. In these components, the positions of the first diaphragm 30 and the second diaphragm 40, the positions of the holes formed in the first diaphragm 30 and the second diaphragm 40, the position where the piezoelectric device 80 is disposed, and other details are different.

Specifically, in the piezoelectric blower 1X according to the comparative embodiment, the first diaphragm 30 is disposed closer to the second nozzle 15 (refer to FIG. 1), and the second diaphragm 40 is disposed closer to the first nozzle 14 (refer to FIG. 1). At the center portion of the first diaphragm 30, a single hole 35 to which the check valve 70 is attached is formed. On the other hand, a piezoelectric device 80 is bonded at the center portion of the second diaphragm 40. The second diaphragm 40 has multiple holes 45, to which no check valve is attached and which are annularly arranged in sequence, in the intermediate portion excluding the center portion and the peripheral portion of the second diaphragm 40.

In the piezoelectric blower 1X having this structure, the first diaphragm 30 and the second diaphragm 40 vibrate to be displaced in directions opposite to each other. Gas is sucked into the pump chamber 21 through the multiple holes 45 formed in the second diaphragm 40, and gas is discharged from the pump chamber 21 through the single hole 35 formed in the first diaphragm 30. The piezoelectric blower 1X having this structure imitates the structures of the piezoelectric pumps disclosed in Patent Documents 1 and 2.

As illustrated in FIG. 6, in the piezoelectric blower 1X according to the comparative embodiment, when the piezoelectric device 80 is driven to satisfy the conditions under which resonance occurs in the pump chamber 21, a loop of pressure fluctuation inside the pump chamber 21 occurs at the center portion of the pump chamber 21, a node of pressure fluctuation of the pump chamber 21 occurs at a predetermined position outside of the center portion of the pump chamber 21, and a loop of pressure fluctuation inside the pump chamber occurs at the outer edge of the pump chamber 21.

In the piezoelectric blower 1A according to the present embodiment, when the piezoelectric device 80 is driven to satisfy the conditions under which resonance occurs in the pump chamber 21, a node of pressure fluctuation inside the pump chamber 21 occurs at a portion adjacent to the center portion of the pump chamber 21, a loop of pressure fluctuation inside the pump chamber 21 occurs at a portion outside of the portion at which the node occurs, a node of pressure fluctuation inside the pump chamber 21 occurs at a portion outside of the portion at which the loop occurs, and a loop of pressure fluctuation inside the pump chamber 21 occurs at the outer edge of the pump chamber 21.

Here, in the piezoelectric blower 1A according to the present embodiment, a node of pressure fluctuation inside the pump chamber 21 occurs more clearly at the position adjacent to the center portion of the pump chamber 21 when the flow path resistance in the single first hole 31 formed at the center portion of the first diaphragm 30 is small (specifically, when the first diaphragm 30 has a sufficiently small thickness and the first hole 31 has a sufficiently large opening area).

In the piezoelectric blower 1A according to the present embodiment, even when the flow path resistance in the single first hole 31 formed at the center portion of the first diaphragm 30 is large (specifically, when the thickness of the first diaphragm 30 is not sufficiently small or when the opening area of the first hole 31 is not sufficiently large), a node of pressure fluctuation inside the pump chamber 21 occurs at the position adjacent to the center portion of the pump chamber 21.

Thus, in the piezoelectric blower 1A according to the present embodiment, resonance occurs inside the pump chamber 21 at a shorter wavelength (that is, at a higher frequency) than that in the case of the piezoelectric blower 1X according to the comparative embodiment. Thus, in the piezoelectric blower 1A according to the present embodiment, the vibration frequency of the diaphragm that satisfies conditions under which resonance occurs inside the pump chamber 21 rises further than in the case of the piezoelectric blower 1X according to the comparative embodiment.

The piezoelectric blower 1A according to the present embodiment can drive the piezoelectric device at a higher frequency than in the existing case, and thus can increase the flow rate further than in the existing case. The piezoelectric blower 1A according to the present embodiment can theoretically increase the flow rate by approximately 20% compared to the piezoelectric blower 1X according to the comparative embodiment.

Figure 7:
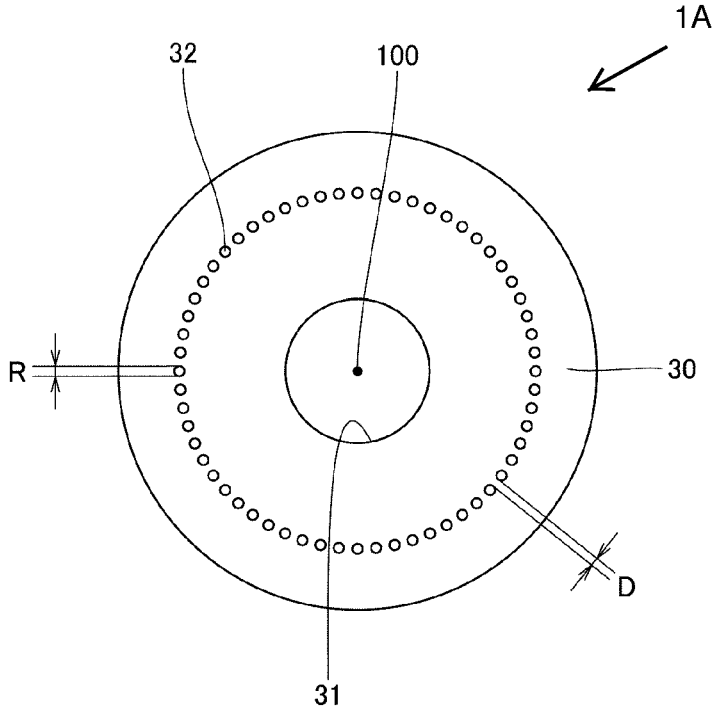
FIG. 7 is a plan view of a first diaphragm illustrated in FIG. 1.

FIG. 7 is a plan view of a first diaphragm illustrated in FIG. 1. With reference to FIG. 7, structures of the piezoelectric blower 1A according to the present embodiment more suitable for increasing the flow rate will be described below.

As illustrated in FIG. 7, in the piezoelectric blower 1A according to the present embodiment, the multiple third holes 32 are annularly arranged in sequence in the intermediate portion excluding the center portion and the peripheral portion of the first diaphragm 30, as described above. In this structure, the gas flow path formed from the single first hole 31 and the multiple third holes 32 formed in the first diaphragm 30 reduces the flow path resistance as a whole, and so that the flow rate can be increased.

Here, the multiple third holes 32 can be multiple cylindrical holes arranged equidistant from each other and having the same opening diameter. In this structure, the axial symmetry of air flow in the pump chamber 21, and thus the axial symmetry of air flow in the piezoelectric blower 1A enhance, so that air flow is less likely to cause turbulence. Thus, gas can flow efficiently, so that the flow rate can be increased.

In this case, a distance D between adjacent two third holes of the multiple third holes 32 can be smaller than an opening diameter R of each of the multiple third holes 32. In this structure, the axial symmetry of the air flow inside the pump chamber 21, and thus the axial symmetry of the air flow inside the piezoelectric blower 1A enhance further, so that the flow rate can be increased further.

On the other hand, the opening area of the single first hole 31 formed in the first diaphragm 30 can be larger than the sum of the opening areas of the multiple second holes 41 formed in the second diaphragm 40. In this structure, the pressure amplitude at the center portion of the pump chamber 21 drops more easily, so that a node of pressure fluctuation inside the pump chamber 21 can occur more reliably at the center portion of the pump chamber 21. Thus, the flow rate can be increased further.

The above-described piezoelectric blower 1A according to the present embodiment has the multiple second holes 41, to which the check valve 70 is attached, and the multiple second holes 41 are annularly arranged in sequence. This structure enables the second holes 41 to increase the total opening area while keeping the axial symmetry of air flow. Thus, the flow rate can be further increased.

In the above-described piezoelectric blower 1A according to the present embodiment, the single first hole 31 to which no check valve is attached is formed in the first diaphragm 30, and the multiple second holes 41, to which the check valve 70 is attached, are formed in the second diaphragm 40. Specifically, the first hole and the second holes are formed in different diaphragms. This structure enables the first hole and the second holes to be easily shielded with, for example, a housing outside of the driving unit. Thus, the flow rate can be further increased.

In the above-described piezoelectric blower 1A according to the present embodiment, the multiple second holes 41 to which the check valve 70 is attached are formed in the second diaphragm 40, and the multiple third holes 32 to which no check valve is attached are formed in the first diaphragm 30. Specifically, the second holes and the third holes are formed in different diaphragms. This structure enables the second holes and the third holes to be easily shielded by, for example, a housing outside of the driving unit. Thus, the flow rate can be further increased.

In the above-described piezoelectric blower 1A according to the present embodiment, the driving unit 20A has no holes other than the single first hole 31, the multiple second holes 41, and the multiple third holes 32. This structure can prevent leakage of gas from the pump chamber 21, and thus can further raise the pressure of the pump chamber 21. Thus, employing this structure can also raise suction pressure and discharge pressure.

In the above-described piezoelectric blower 1A according to the present embodiment, the piezoelectric device 80, which is a first piezoelectric device serving as a driver, is bonded to the second diaphragm 40 facing the first diaphragm 30 having the single first hole 31 to which no check valve is attached. Here, in an assumed structure in which the piezoelectric device 80 is bonded to the first diaphragm 30, the piezoelectric device 80 needs to have a through-hole that is continuous with the first hole 31, which is not necessarily advantageous in view of, for example, manufacturing costs and reliability. On the other hand, the above-described structure has no need to form a through-hole in the piezoelectric device 80, and so that an inexpensive and highly reliable piezoelectric blower can be formed.

In addition, in the piezoelectric blower 1A according to the present embodiment, the first diaphragm 30, the second diaphragm 40, and the piezoelectric device 80 have a circular shape when viewed in a plan. This structure further enhances the axial symmetry of air flow in the pump chamber 21, and thus the axial symmetry of air flow inside the piezoelectric blower 1A. Thus, the flow rate can be further increased.

The dimensions of components of the above-described piezoelectric blower 1A according to the present embodiment, the numbers of the various holes formed in the first diaphragm 30 and the second diaphragm 40, and other details are not limited to particular ones. The examples for those are as follows.

The first diaphragm 30 has a diameter of, for example, 27 mm. The portion of the first diaphragm 30 that defines the pump chamber 21 has a diameter of, for example, 23 mm. The second diaphragm 40 has a diameter of, for example, 25 mm. The portion of the second diaphragm 40 that defines the pump chamber 21 has a diameter of, for example, 23 mm. The first diaphragm 30 and the second diaphragm 40 have a thickness of, for example, 0.3 mm. The spacer 50 has an outer diameter and an inner diameter of, for example, 25 mm and 23 mm, respectively.

The single first hole 31 formed in the first diaphragm 30 has a diameter of, for example, 8 mm. The multiple second holes 41 formed in the second diaphragm 40 are annularly arranged in sequence, for example, 6 mm apart from the center of the second diaphragm 40. The multiple second holes 41 have an opening diameter of, for example, 0.4 mm. The number of the second holes 41 is approximately 80 at maximum. The multiple third holes 32 formed in the first diaphragm 30 are annularly arranged in sequence, for example, 9 mm apart from the center of the first diaphragm 30. The multiple third holes 32 have an opening diameter of, for example, 0.4 mm. The number of the third holes 32 is approximately 100 at maximum.

Modification Example

Figure 8:
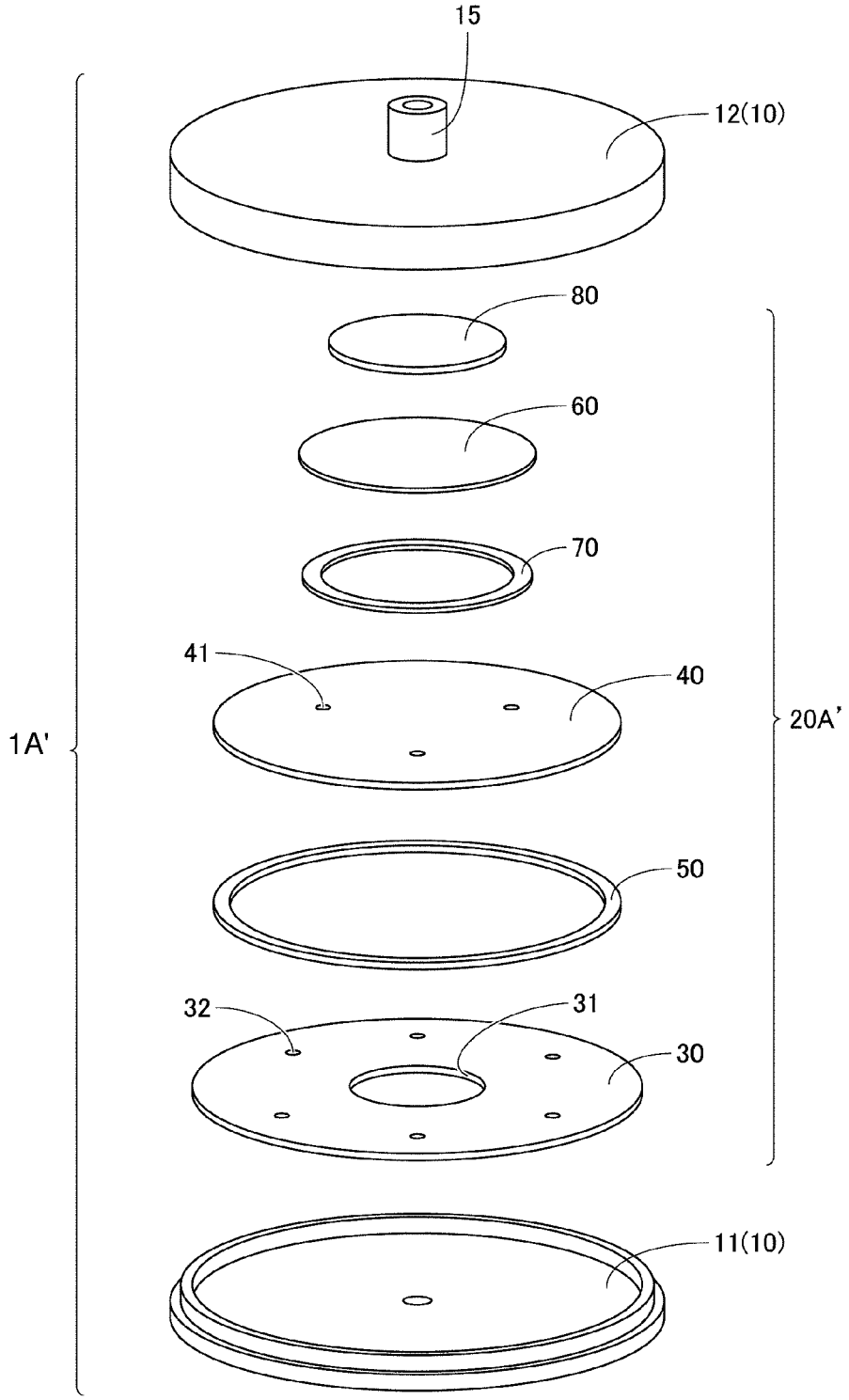
FIG. 8 is an exploded perspective view of a piezoelectric blower according to a modification example.

FIG. 8 is an exploded perspective view of a piezoelectric blower according to a modification example of embodiment 1. A piezoelectric blower 1A' according to the modification example will be described with reference to FIG. 8, below.

As illustrated in FIG. 8, the piezoelectric blower 1A' according to a modification example includes a driving unit 20A' having a structure different from that of the above-described piezoelectric blower 1A according to embodiment 1. As in the case of the driving unit 20A of the above-described piezoelectric blower 1A according to embodiment 1, the driving unit 20A' includes components such as a first diaphragm 30, a second diaphragm 40, a spacer 50, a valve holding member 60, a check valve 70, and a piezoelectric device 80. However, the numbers of holes formed in the first diaphragm 30 and the second diaphragm 40 are different.

Specifically, in the piezoelectric blower 1A' according to the modification example, the number of the multiple second holes 41 formed in the second diaphragm 40 is significantly reduced compared to that of the above-described piezoelectric blower 1A according to embodiment 1; the number of the multiple second holes 41 is three. The number of the multiple third holes 32 formed in the first diaphragm 30 is significantly reduced compared to that of the above-described piezoelectric blower 1A according to embodiment 1; the number of the multiple third holes 32 is six.

This structure can also obtain effects similar to the effects described above in embodiment 1, so that a piezoelectric blower that increases the flow rate further than in an existing structure can be formed. As in this case, the number of holes formed in the second diaphragm 40 is not limited to a particular one, and may be any number larger than or equal to one.

The present modification example described above is a case where the number of the multiple third holes 32 formed in the first diaphragm 30 and the number of the multiple second holes 41 formed in the second diaphragm 40 are both reduced compared to the above-described piezoelectric blower 1A according to embodiment 1. However, only one of the number of the multiple third holes 32 formed in the first diaphragm 30 and the number of the multiple second holes 41 formed in the second diaphragm 40 may be reduced.

Embodiment 2

Figure 9:
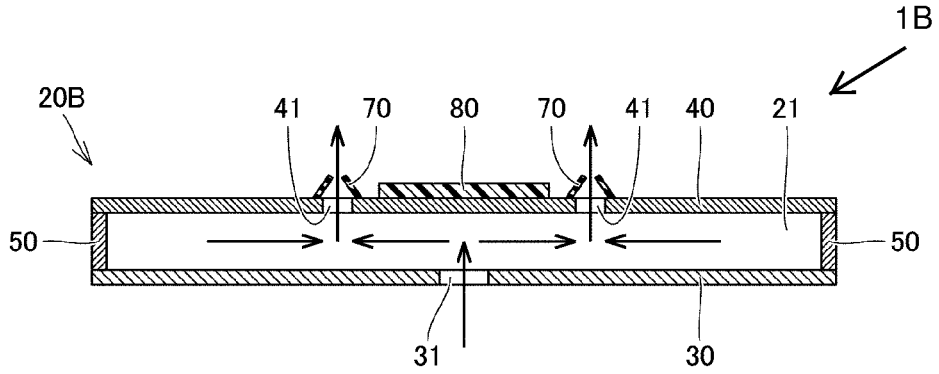
FIG. 9 is a schematic diagram of a structure of a driving unit of a piezoelectric blower according to embodiment 2 and rough directions of air flow caused during an operation of the driving unit.

FIG. 9 is a schematic diagram of a structure of a driving unit of a piezoelectric blower according to embodiment 2 of the present disclosure and rough directions of air flow caused during an operation of the driving unit. A piezoelectric blower 1B according to the present embodiment will be described below with reference to FIG. 9.

As illustrated in FIG. 9, the piezoelectric blower 1B according to the present embodiment includes a driving unit 20B, which has a structure different from that of the above-described piezoelectric blower 1A according to embodiment 1. As in the case of the driving unit 20A of the above-described piezoelectric blower 1A according to embodiment 1, the driving unit 20B includes components such as a first diaphragm 30, a second diaphragm 40, a spacer 50, a check valve 70, and a piezoelectric device 80. However, the form of holes formed in the first diaphragm 30 is different.

Specifically, in the piezoelectric blower 1B according to the present embodiment, the first diaphragm 30 has a single first hole 31 at the center portion of the first diaphragm 30, and has no holes in the intermediate portion excluding the center portion and the peripheral portion of the first diaphragm 30. Specifically, no holes other than the single first hole 31 formed in the first diaphragm 30 and the multiple second holes 41 formed in the second diaphragm 40 are formed in the first diaphragm 30, the second diaphragm 40, and the spacer 50, which define the pump chamber 21.

This structure can also obtain effects similar to the effects described in embodiment 1, so that a piezoelectric blower that increases the flow rate further than in an existing structure can be formed. The structure has no holes other than the single first hole 31 and the multiple second holes 41 in the driving unit 20B. This structure can thus more effectively prevent leakage of gas from the pump chamber 21, and thus can further enhance the pressure in the pump chamber 21. Employing this structure can thus enhance suction pressure and discharge pressure. As described above, the first diaphragm 30 will suffice if it has, at its center portion, at least the single first hole 31 to which no valve is attached. The first diaphragm 30 does not necessarily have to have a hole in the intermediate portion excluding the center portion and the peripheral portion of the first diaphragm 30.

In the structure according to the present embodiment, the axial symmetry while the first diaphragm 30 is vibrating improves, so that energy loss resulting from vibrations can be reduced, and the piezoelectric blower can be efficiently driven. Particularly, when the first diaphragm 30 has no holes in the intermediate portion, the first diaphragm 30 having a smaller thickness can achieve resonance in the pump chamber 21. Thus, the first diaphragm 30 can be displaced to a larger extent, so that the flow rate can be further increased.

Embodiment 3

Figure 10:
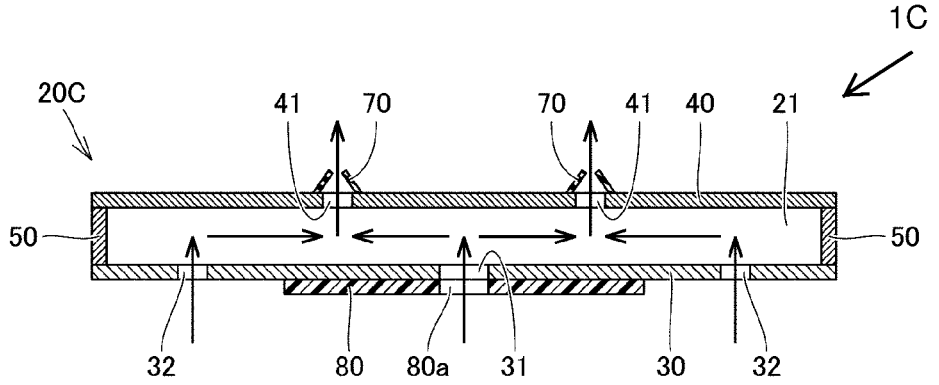
FIG. 10 is a schematic diagram of a structure of a driving unit of a piezoelectric blower according to embodiment 3 and rough directions of air flow caused during an operation of the driving unit.

FIG. 10 is a schematic diagram of a structure of a driving unit of a piezoelectric blower according to embodiment 3 of the present disclosure and rough directions of air flow caused during an operation of the driving unit. A piezoelectric blower 1C according to the present embodiment will be described below with reference to FIG. 10.

As illustrated in FIG. 10, the piezoelectric blower 1C according to the present embodiment includes a driving unit 20C having a structure different from that of the above-described piezoelectric blower 1A according to embodiment 1. As in the driving unit 20A of the above-described piezoelectric blower 1A according to embodiment 1, the driving unit 20C includes components such as a first diaphragm 30, a second diaphragm 40, a spacer 50, a check valve 70, and a piezoelectric device 80. However, the position where the piezoelectric device 80 is disposed and the structure of the piezoelectric device 80 are different.

Specifically, in the piezoelectric blower 1C according to the present embodiment, the driving unit 20C includes a piezoelectric device 80 having a through-hole 80*a*. The piezoelectric device 80 corresponds to a second piezoelectric device serving as a driver. The piezoelectric device 80 is bonded at the center portion of the first diaphragm 30. More specifically, the piezoelectric device 80 is bonded to the main surface of the first diaphragm 30 opposite to the surface facing the pump chamber 21.

In order not to close the single first hole 31 at the center portion of the first diaphragm 30, the piezoelectric device 80 is bonded to the first diaphragm 30 while allowing the through-hole 80*a* formed in the piezoelectric device 80 to be continuous with the single first hole 31 formed in the first diaphragm 30.

As in the case of embodiment 1, the piezoelectric device 80 having the through-hole 80*a* vibrates the first diaphragm 30 and the second diaphragm 40 at respective resonant frequencies in response to applications of AC voltages of predetermined frequencies to cause standing waves in both the first diaphragm 30 and the second diaphragm 40.

This structure can also obtain effects the same as the effects described in embodiment 1, and can form a piezoelectric blower that increases the flow rate compared to an existing structure.

Embodiment 4

Figure 11:
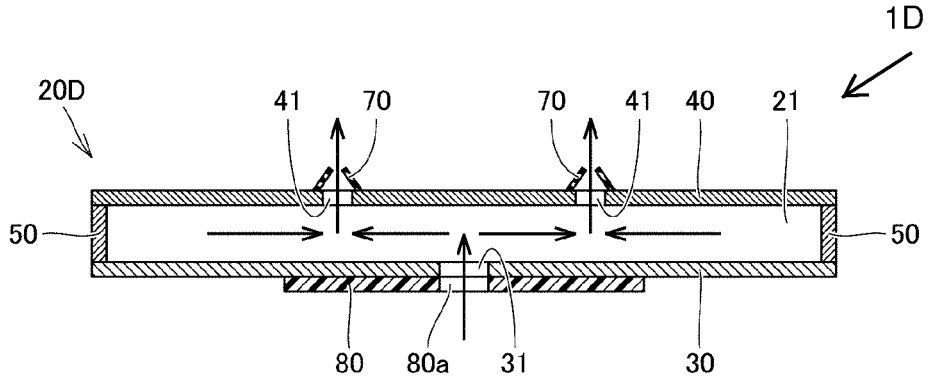
FIG. 11 is a schematic diagram of a structure of a driving unit of a piezoelectric blower according to embodiment 4 and rough directions of air flow caused during an operation of the driving unit.

FIG. 11 is a schematic diagram of a structure of a driving unit of a piezoelectric blower according to embodiment 4 of the present disclosure and rough directions of air flow caused during an operation of the driving unit. A piezoelectric blower 1D according to the present embodiment will be described below with reference to FIG. 11.

As illustrated in FIG. 11, the piezoelectric blower 1D according to the present embodiment includes a driving unit 20D having a structure different from that of the piezoelectric blower 1C according to embodiment 3. As in the driving unit 20C of the piezoelectric blower 1C according to embodiment 3, the driving unit 20D includes components such as a first diaphragm 30, a second diaphragm 40, a spacer 50, a check valve 70, and a piezoelectric device 80. However, the form of holes formed in the first diaphragm 30 is different.

Specifically, in the piezoelectric blower 1D according to the present embodiment, the first diaphragm 30 has a single first hole 31 at the center portion of the first diaphragm 30, and has no holes in the intermediate portion excluding the center portion and the peripheral portion of the first diaphragm 30. Specifically, no holes other than the single first hole 31 formed in the first diaphragm 30 and the multiple second holes 41 formed in the second diaphragm 40 are formed in the first diaphragm 30, the second diaphragm 40, and the spacer 50, which define the pump chamber 21.

This structure also has effects similar to the effects described above in embodiment 3, so that a piezoelectric blower that increases the flow rate further than in an existing structure can be formed. The structure according to the present embodiment can also obtain additional effects described above in embodiment 2.

Embodiment 5

Figure 12:
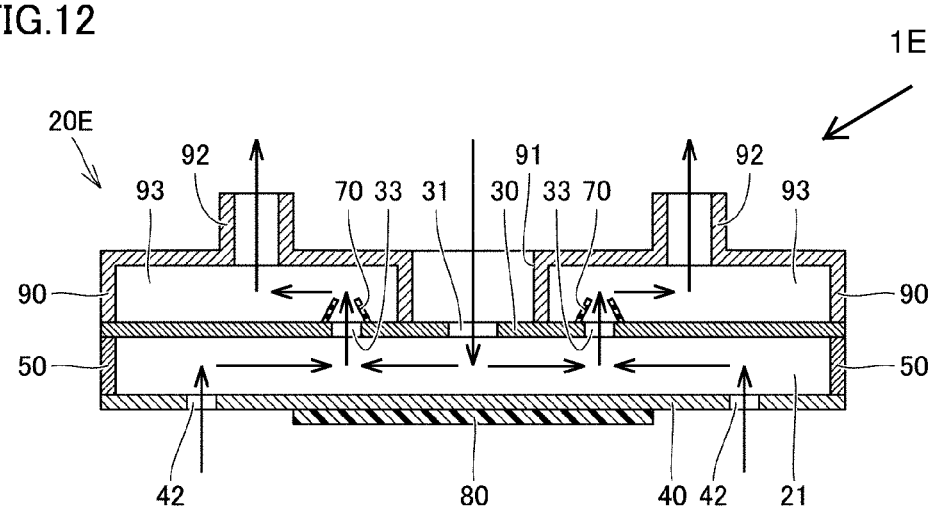
FIG. 12 is a schematic diagram of a structure of a driving unit of a piezoelectric blower according to embodiment 5 and rough directions of air flow caused during an operation of the driving unit.

FIG. 12 is a schematic diagram of a structure of a driving unit of a piezoelectric blower according to embodiment 5 of the present embodiment and rough directions of air flow caused during an operation of the driving unit. A piezoelectric blower 1E according to the present embodiment will be described below with reference to FIG. 12.

As illustrated in FIG. 12, the piezoelectric blower 1E according to the present embodiment includes a driving unit 20E having a structure different from that of the above-described piezoelectric blower 1A according to embodiment 1. As in the driving unit 20A of the above-described piezoelectric blower 1A according to embodiment 1, the driving unit 20E includes components such as a first diaphragm 30, a second diaphragm 40, a spacer 50, a check valve 70, and a piezoelectric device 80. In these components, the positions of the first diaphragm 30 and the second diaphragm 40, the positions of holes formed in the first diaphragm 30 and the second diaphragm 40, the positions where the piezoelectric device 80 is disposed, and other details are different. The driving unit 20E is different in that it includes a shielding member 90.

Specifically, in the piezoelectric blower 1E according to the present embodiment, the first diaphragm 30 is disposed closer to the second nozzle 15 (refer to FIG. 1), and the second diaphragm 40 is disposed closer to the first nozzle 14 (refer to FIG. 1). The shielding member 90 is disposed on the surface of the first diaphragm 30 opposite to the surface on which the second diaphragm 40 is disposed (that is, disposed closer to the second nozzle 15), and bonded to the first diaphragm 30 with, for example, an adhesive.

The shielding member 90 includes a metal-made or resin-made bottomed-annular member having a through-hole 91 at the center portion. The shielding member 90 includes a third nozzle 92, which protrudes outward, at the bottom, and a flow path 93 inside. The third nozzle 92 is connected to one of the first nozzle 14 and the second nozzle 15 (refer to FIG. 1) of the housing 10 (here, the second nozzle 15) that functions as the discharge nozzle. A space in the accommodating space 13 of the housing 10 where the driving unit 20E including the shielding member 90 is not disposed is connected to one of the first nozzle 14 and the second nozzle 15 (refer to FIG. 1) of the housing 10 (here, the first nozzle 14) that functions as the suction nozzle.

The first diaphragm 30 has a single first hole 31 to which no check valve is attached, at the center portion of the first diaphragm 30 and at a portion facing the through-hole 91 of the shielding member 90. The first diaphragm 30 also has multiple second holes 33 to which the check valve 70 is attached, in the intermediate portion excluding the center portion and the peripheral portion of the first diaphragm 30 and at a portion facing the flow path 93 of the shielding member 90. The multiple second holes 33 can be annularly arranged in sequence.

On the other hand, the piezoelectric device 80 is bonded at the center portion of the second diaphragm 40. More specifically, the piezoelectric device 80 is bonded to the main surface of the second diaphragm 40 opposite to the surface facing the pump chamber 21. The second diaphragm 40 has multiple third holes 42 to which no check valve is attached, in the intermediate portion excluding the center portion and the peripheral portion of the second diaphragm 40. The multiple third holes 42 can be annularly arranged in sequence.

In the piezoelectric blower 1E according to the present embodiment having the above structure, the pump chamber 21 is located between the first nozzle 14 and the second nozzle 15. The space of the accommodating space 13 of the housing 10 directly continuous with the first nozzle 14 and the pump chamber 21 are always continuous with each other through the single first hole 31 formed in the first diaphragm 30 and the multiple third holes 42 formed in the second diaphragm 40. The third nozzle 92 and the flow path 93 of the shielding member 90 directly continuous with the second nozzle 15 in the accommodating space 13 of the housing 10 and the pump chamber 21 are continuous with each other with the multiple second holes 33 when the multiple second holes 33 formed in the first diaphragm 30 are not closed by the check valve 70.

In the piezoelectric blower 1E having the above structure, the first diaphragm 30 and the second diaphragm 40 vibrate to be displaced in opposite directions. Thus, gas is sucked into the pump chamber 21 through the single first hole 31 formed in the first diaphragm 30 and the multiple third holes 42 formed in the second diaphragm 40, and gas is discharged from the pump chamber 21 through the multiple second holes 33 formed in the first diaphragm 30.

This structure can also obtain effects similar to the effects described above in embodiment 1, so that a piezoelectric blower that increases the flow rate further than in an existing structure can be formed. Since the single first hole 31 formed in the first diaphragm 30 and the multiple second holes 33 are located relatively close to each other, the above-described shielding member 90 is disposed to prevent gas from flowing backward between these holes, and is not indispensable.

Embodiment 6

Figure 13:
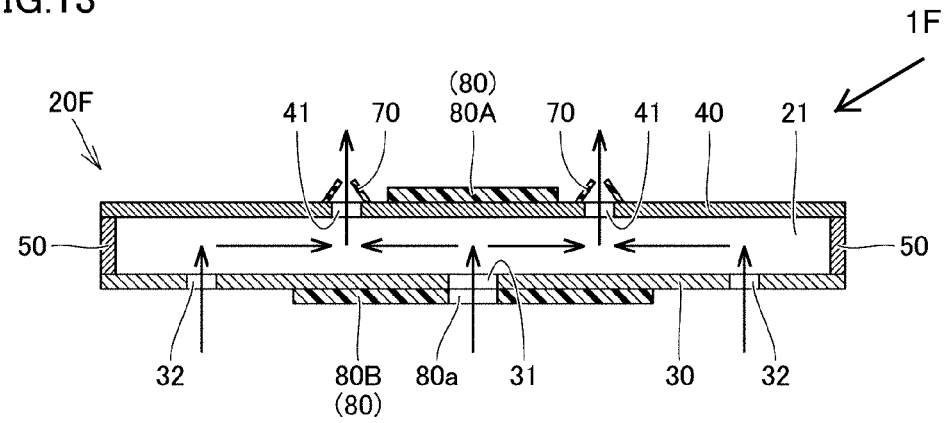
FIG. 13 is a schematic diagram of a structure of a driving unit of a piezoelectric blower according to embodiment 6 and rough directions of air flow caused during an operation of the driving unit.

FIG. 13 is a schematic diagram of a structure of a driving unit of a piezoelectric blower according to embodiment 6 of the present disclosure and rough directions of air flow caused during an operation of the driving unit. A piezoelectric blower 1F according to the present embodiment will be described below with reference to FIG. 13.

As illustrated in FIG. 13, the piezoelectric blower 1F according to the present embodiment includes a driving unit 20F having a structure different from that of the above-described piezoelectric blower 1A according to embodiment 1. As in the case of the driving unit 20A of the above-described piezoelectric blower 1A according to embodiment 1, the driving unit 20F includes components such as a first diaphragm 30, a second diaphragm 40, a spacer 50, and a check valve 70. However, the structure of the piezoelectric device 80 serving as a driver is different.

Specifically, in the piezoelectric blower 1F according to the present embodiment, the driving unit 20F includes two piezoelectric devices 80A and 80B serving as drivers. The piezoelectric device 80A having a plate shape and serving as a first piezoelectric device is bonded at the center portion of the second diaphragm 40 with a valve holding member not illustrated interposed therebetween. The piezoelectric device 80B having a through-hole 80*a* and serving as a second piezoelectric device, on the other hand, is bonded at the center portion of the first diaphragm 30. Here, the piezoelectric device 80B is bonded to the first diaphragm 30 while allowing the through-hole 80*a* formed in the piezoelectric device 80B to be continuous with the single first hole 31 formed in the first diaphragm 30.

These two piezoelectric devices 80A and 80B separately vibrate, at respective resonant frequencies, the second diaphragm 40 and the first diaphragm 30 to which the piezoelectric devices 80A and 80B are bonded so that the second diaphragm 40 and the first diaphragm 30 are displaced in opposite directions. Thus, standing waves occur in both the second diaphragm 40 and the first diaphragm 30.

This structure can also obtain effects similar to the effects described above in embodiment 1, so that a piezoelectric blower that increases the flow rate further than in an existing structure can be formed. This structure can also increase displacement of the first diaphragm 30 and the second diaphragm 40 compared to the case of embodiment 1, and thus can increase the flow rate.

Embodiment 7

Figure 14:
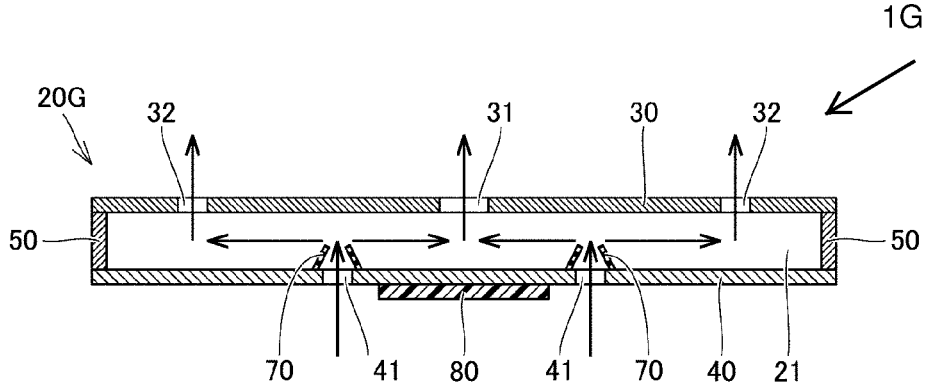
FIG. 14 is a schematic diagram of a structure of a driving unit of a piezoelectric blower according to embodiment 7 and rough directions of air flow caused during an operation of the driving unit.

FIG. 14 is a schematic diagram of a structure of a driving unit of a piezoelectric blower according to embodiment 7 of the present disclosure and rough directions of air flow caused during an operation of the driving unit. A piezoelectric blower 1G according to the present embodiment will now be described below with reference to FIG. 14.

As illustrated in FIG. 14, the piezoelectric blower 1G according to the present embodiment includes a driving unit 20G having a structure different from that of the above-described piezoelectric blower 1A according to embodiment 1. As in the case of the driving unit 20A of the above-described piezoelectric blower 1A according to embodiment 1, the driving unit 20G includes components such as a first diaphragm 30, a second diaphragm 40, a spacer 50, a check valve 70, and a piezoelectric device 80. In these components, the positions of the first diaphragm 30 and the second diaphragm 40, the positions of the holes formed in the first diaphragm 30 and the second diaphragm 40, the position where the check valve 70 is disposed, the position where the piezoelectric device 80 is disposed, and other details are different.

Specifically, in the piezoelectric blower 1G according to the present embodiment, the first diaphragm 30 is disposed closer to the second nozzle 15 (refer to FIG. 1), and the second diaphragm 40 is disposed closer to the first nozzle 14 (refer to FIG. 1).

The first diaphragm 30 has the single first hole 31 to which no valve is attached is disposed at the center portion of the first diaphragm 30, and has multiple third holes 32 to which no check valve is attached in the intermediate portion excluding the center portion and the peripheral portion of the first diaphragm 30. The multiple third holes 32 can be annularly arranged in sequence.

On the other hand, multiple second holes 41 to which the check valve 70 is attached are formed in the intermediate portion excluding the center portion and the peripheral portion of the second diaphragm 40. The multiple second holes 41 can be annularly arranged in sequence.

Here, a valve holding member not illustrated is bonded, with, for example, an adhesive at a center portion of the main surface of the second diaphragm 40 facing the pump chamber 21 (specifically, the surface on which the first diaphragm 30 is disposed), and the check valve 70 is movably held by the valve holding member. Thus, the check valve 70 is attached to the multiple second holes 41 to render each of the multiple second holes 41 open and closed.

The piezoelectric device 80 is bonded at the center portion of the main surface of the second diaphragm 40 that does not face the pump chamber 21 (specifically, the surface opposite to the surface on which the first diaphragm 30 is disposed).

In the piezoelectric blower 1G according to the present embodiment having the above-described structure, the pump chamber 21 is disposed between the first nozzle 14 and the second nozzle 15. The space of the accommodating space 13 of the housing 10 closer to the first nozzle 14 with respect to the portion where the pump chamber 21 is disposed and the pump chamber 21 are continuous with each other through the multiple second holes 41 in the state where the multiple second holes 41 formed in the second diaphragm 40 are not closed by the check valve 70. The space of the accommodating space 13 of the housing 10 closer to the second nozzle 15 with respect to the portion where the pump chamber 21 is disposed and the pump chamber 21 are always continuous with each other through the single first hole 31 and the multiple third holes 32 formed in the first diaphragm 30.

In the piezoelectric blower 1G having the above structure, the first diaphragm 30 and the second diaphragm 40 vibrate to be displaced in opposite directions. Thus, gas is sucked into the pump chamber 21 through the multiple second holes 41 formed in the second diaphragm 40, and gas is discharged from the pump chamber 21 through the single first hole 31 and the multiple third holes 32 formed in the first diaphragm 30.

This structure can also obtain effects similar to the effects described above in embodiment 1, so that a piezoelectric blower that increases the flow rate further than in an existing structure can be formed.

(Others)

In embodiments 1 to 7 according to the present disclosure and modification examples of embodiments 1 to 7 described above, a case where the second holes to which the check valve is attached are annularly arranged in sequence has been described by way of example. However, the second holes do not necessarily have to be annularly arranged in sequence, and may be arranged in any appropriate layout. Similarly, the third holes to which no check valve is attached do not necessarily have to be annularly arranged in sequence, and may be arranged in any appropriate layout.

In embodiments 1 to 7 according to the present disclosure and modification examples of embodiments 1 to 7 described above, a case where a piezoelectric device having no through-hole, a piezoelectric device having a through-hole, or both are used as a driver/drivers has been described by way of example. Here, a piezoelectric device having no through-hole can be used. This is because the piezoelectric device having no through-hole has a larger area when viewed in a plan for the absence of the through-hole, and thus can displace the diaphragm to a larger extent. In addition, the piezoelectric device having no through-hole is advantageous in terms of reliability and manufacturing costs for the absence of the through-hole.

In embodiments 1 to 7 according to the present disclosure and modification examples of embodiments 1 to 7 described above, a case where each of the first diaphragm, the second diaphragm, and the driver has a circular profile has been described by way of example. However, they may have, for example, a polygonal or oval shape as long as they can obtain approximately equivalent axial symmetry.

The characteristic structures described in embodiments 1 to 7 according to the present disclosure and modification examples of embodiments 1 to 7 described above may be combined as appropriate within the scope not departing from the gist of the present disclosure.

In embodiments 1 to 7 according to the present disclosure and modification examples of embodiments 1 to 7 described above, a case where the present disclosure is applied to a piezoelectric blower that sucks and discharges gas has been described by way of example. However, the present disclosure is also applicable to a pump that sucks and discharges liquid or a pump that includes a device other than a piezoelectric device for use as a driver (naturally, this pump is limited to a positive-displacement pump that operates using flexural vibration of a diaphragm).

In embodiments 1 to 7 according to the present disclosure and modification examples of embodiments 1 to 7 described above, among a pump and a fluid control device to which the present disclosure is applied, only the pump to which the present disclosure is applied has been described in detail. However, the fluid control device to which the present disclosure is applied includes the pump to which the present disclosure is applied. Specifically, the fluid control device to which the present disclosure is applied is a fluid system including, as a component, the pump to which the present disclosure is applied (for example, a piezoelectric blower according to any one of embodiments 1 to 7 according to the present disclosure and modification examples of embodiments 1 to 7 described above). The pump and other fluid control components operate in cooperation to control the behavior of the fluid in accordance with the purpose of use.

As described above, the embodiments and modification examples disclosed here are mere examples in all respects, and nonlimitative. The technical scope of the present disclosure is defined by the scope of claims, and includes the description of the scope of claims, equivalents thereof, and all the changes within the scope.

REFERENCE SIGNS LIST

1A to 1G, 1A' piezoelectric blower
10 housing
11 first case body
12 second case body
13 accommodating space
14 first nozzle
15 second nozzle
20A to 20G, 20A' driving unit
21 pump chamber
30 first diaphragm
31 first hole
32 third hole
33 second hole
40 second diaphragm
41 second hole
42 third hole
50 spacer
60 valve holding member
61 annular step portion
70 check valve
80, 80A, 80B piezoelectric device
80*a* through-hole
90 shielding member
91 through-hole
92 third nozzle
93 flow path
100 axis

The invention claimed is:

1. A pump, comprising:
a first diaphragm;
a second diaphragm facing the first diaphragm, wherein an axis extends through a center of the first diaphragm and a center of the second diaphragm and is orthogonal to a plan view of the first diaphragm and the second diaphragm;
a circumferential wall that connects a periphery of the first diaphragm and a periphery of the second diaphragm to each other;
a pump chamber located between the first diaphragm and the second diaphragm, and defined by the first diaphragm, the second diaphragm, and the circumferential wall; and
a driver that vibrates the first diaphragm and the second diaphragm in a flexural mode to cause pressure fluctuation in the pump chamber,
wherein the first diaphragm has a first hole to which no check valve is attached, at a portion that coincides with the axis when viewed in a direction in which the axis extends, and
wherein at least one of the first diaphragm and the second diaphragm has a second hole to which a check valve is attached, at a portion that does not coincide with the first hole when viewed in the direction in which the axis extends, wherein at least one of the first diaphragm and the second diaphragm has a third hole to which no check valve is attached in an area closer to an outer side from the axis than an area including the second hole when viewed in the direction in which the axis extends.

2. The pump according to claim 1, wherein the second hole is in the second diaphragm.

3. The pump according to claim 1,
comprising a plurality of the second holes, and
wherein the plurality of the second holes are circumferentially arranged in sequence on the second diaphragm.

4. The pump according to claim 3, wherein an opening area of the first hole is greater than a sum of opening areas of the plurality of the second holes.

5. The pump according to claim 1,
wherein the second hole is in the second diaphragm, and
wherein the third hole is in the first diaphragm.

6. The pump according to claim 1 comprising a plurality of the third holes, and
wherein the plurality of the third holes are circumferentially arranged in sequence on the first diaphragm.

7. The pump according to claim 6,
wherein the plurality of the third holes is a plurality of cylindrical holes arranged equidistant from each other and having an identical opening diameter, and
wherein a distance between each adjacent two third holes of the plurality of the third holes is smaller than the opening diameter of each of the plurality of the third holes.

8. The pump according to claim 1,
wherein there are no holes other than the first hole, the second hole, and the third hole in any of the first diaphragm, the second diaphragm, and the circumferential wall.

9. The pump according to claim 1,
wherein the driver vibrates the first diaphragm and the second diaphragm in a flexural mode to cause standing waves in both the first diaphragm and the second diaphragm with respect to the axis at the center.

10. The pump according to claim 1,
wherein each of the first diaphragm, the second diaphragm, and the driver has a circular profile when viewed in the direction in which the axis extends.

11. The pump according to claim 1,
wherein the driver includes a plate-shaped first piezoelectric device, and
wherein the first piezoelectric device is bonded to the second diaphragm.

12. The pump according to claim 1,
wherein the driver includes a plate-shaped piezoelectric device having a through-hole at a center, and
wherein the piezoelectric device is bonded to the first diaphragm while allowing the through-hole and the first hole to be continuous with each other.

13. The pump according to claim 2, comprising a plurality of the second holes in the second diaphragm, and
wherein the plurality of the second holes are circumferentially arranged in sequence on the second diaphragm.

14. The pump according to claim 2, wherein there are no other holes other than the first hole the second hole, and the third hole in any of the first diaphragm, the second diaphragm, and the circumferential wall.

15. The pump according to claim 3, wherein there are no other holes other than the first hole, the second hole, and the third hole in any of the first diaphragm, the second diaphragm, and the circumferential wall.

16. The pump according to claim 4, wherein there are no other holes other than the first hole, the second hole, and the third hole in any of the first diaphragm, the second diaphragm, and the circumferential wall.

* * * * *